US010278558B1

(12) United States Patent
Ebrahimi Afrouzi

(10) Patent No.: US 10,278,558 B1
(45) Date of Patent: May 7, 2019

(54) BRUSH WITH PRESSURE SENSOR

(71) Applicant: Ali Ebrahimi Afrouzi, San Jose, CA (US)

(72) Inventor: Ali Ebrahimi Afrouzi, San Jose, CA (US)

(73) Assignee: Al Incorporated, Toronto (CA)

( * ) Notice: Subject to any disclaimer, the term of this patent is extended or adjusted under 35 U.S.C. 154(b) by 3 days.

(21) Appl. No.: 15/791,892

(22) Filed: Oct. 24, 2017

Related U.S. Application Data

(60) Provisional application No. 62/404,704, filed on Oct. 5, 2016.

(51) Int. Cl.
*A47L 9/04* (2006.01)
*A47L 9/28* (2006.01)

(52) U.S. Cl.
CPC ..... *A47L 9/2821* (2013.01); *A47L 9/0477* (2013.01); *A47L 9/2857* (2013.01); *A47L 9/2889* (2013.01); *A47L 2201/00* (2013.01)

(58) Field of Classification Search
CPC .... A47L 9/2821; A47L 9/0477; A47L 9/2857; A47L 9/2889; A47L 2201/00
See application file for complete search history.

(56) References Cited

U.S. PATENT DOCUMENTS

| | | | |
|---|---|---|---|
| 5,940,927 | A | 8/1999 | Haegermarck et al. |
| 6,605,156 | B1 | 8/2003 | Clark et al. |
| 7,599,758 | B2 | 11/2009 | Reindle et al. |
| 8,600,553 | B2 | 12/2013 | Svendsen et al. |
| 9,457,471 | B2 | 10/2016 | Schnittman et al. |
| 2005/0278888 | A1 | 12/2005 | Reindle et al. |
| 2010/0313910 | A1 | 12/2010 | Lee et al. |
| 2017/0080570 | A1 | 3/2017 | Schnittman et al. |

*Primary Examiner* — David Redding

(57) ABSTRACT

A rotatable brush with a pressure sensor for detecting entanglements. If the amount of pressure around the brush reaches a predetermined threshold, a toggle extending along the length of the brush shaft switches from a default position to a secondary position and actuates the pressure sensor. The pressure sensor is electronically coupled to a processor and/or controller to activate one or more preprogrammed responses when an entanglement is putting pressure on the brush.

16 Claims, 3 Drawing Sheets

BRUSH WITH PRESSURE SENSOR

CROSS-REFERENCE TO RELATED APPLICATIONS

This application claims the benefit of provisional patent application Ser. No. 62/404,704, filed Oct. 5, 2016 by the present inventor.

FIELD OF INVENTION

The present invention relates generally to mobile robotic vacuum cleaners and more particularly to mobile robotic vacuum cleaner brushes.

BACKGROUND OF THE INVENTION

A common feature in robotic vacuums are main and side brushes. The purpose of a brush is to achieve the cleaning of debris in the work environment. However, since the brushes spin, an immense issue that has arisen is the entanglement of the brushes with electrical cords, cables, wires and the like in the work environment. As the brush spins, the electrical cord or wire will be caught up in the spinning mechanism and become stuck around the spinning brush thus disabling the brush as well as the robotic vacuum itself. In turn, an operator has to come and detangle the wire from the mobile robot which is undesirable.

In prior art, the amount of current generated by a separate brush motor has been used to detect entanglement with an obstruction as the power required and the current generated in rotating the brush would increase if entanglement occurred. Once entanglement is detected the brush is programmed to stop and reverse direction until the current is below a certain threshold, at which time the robotic device may resume operation. However, an increase in the current generated by the brush motor may occur for reasons other than an entanglement with an obstruction, resulting in false detection of a brush entanglement. For example, when operating on a thick pile carpet the current generated by the brush motor may increase because more power is required to rotate the brush through thick pile carpet. This may trigger the brush motor to stop and the brush to operate in the reverse direction when not needed. A need exists for a more accurate method to identify entanglements on vacuum brushes.

SUMMARY

The present disclosure proposes a rotatable brush with a pressure sensor for detecting entanglements.

The brush comprises a rotatable shaft with a plurality of bristles radially protruding therefrom; and a pressure sensor comprising: a toggle extending along the length of the shaft, and a sensor actuated by the toggle, wherein the toggle has a first default position and a second position, and wherein when the toggle switches from the first default position into the second position due to force from an entanglement on or around the shaft, the sensor is actuated.

BRIEF DESCRIPTION OF DRAWINGS

Non-limiting and non-exhaustive features of the present invention are described with reference to the following figures, wherein like reference numerals refer to like parts throughout the various figures.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details.

As understood herein, the term "robot" or "robotic device" may be defined generally to include one or more autonomous devices having communication, mobility, and/or processing elements. For example, a robot or robotic device may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., and one or more clock or synchronizing devices.

The present invention proposes a rotatable brush comprised of a shaft with a plurality of bristles protruding radially therefrom and a pressure sensor comprising a toggle extending along the length of the shaft that may be switched from a first position to a second position and a sensor connected thereto. When the toggle is in the second position, the sensor is actuated. The standard position of the toggle is in the first position where the sensor is not actuated. If pressure around the brush reaches a predetermined threshold, the toggle will be forced from the first position to a second position, actuating the sensor. The sensor may be electronically coupled with a processor or controller so that when the sensor is actuated, a variety of responses may be programmed to occur. Responses may include any of the following, separately or in combination: halting rotation of the brush, reversing rotation of the brush, temporarily reversing rotation of the brush, slowing rotation of the brush, pausing rotation of the brush, turning off a device containing the brush, activating an alert on a device containing the brush, and altering the operation of a device containing the brush in any other way. In some embodiments, responses may be triggered only after the sensor has been actuated for a predetermined length of time.

It will be obvious to persons skilled in the art that such a brush may be used in various types of surface cleaning devices, such as, but not limited to, robotic vacuum cleaners, upright vacuum cleaners, or other surface cleaning devices.

A plurality of shorter toggles may be employed instead of a single toggle extending the length of the shaft without departing from the scope of the invention.

Various types of mechanical or electronic pressure sensors or pressure-actuated switches may be employed as the sensor.

Figure 1A:
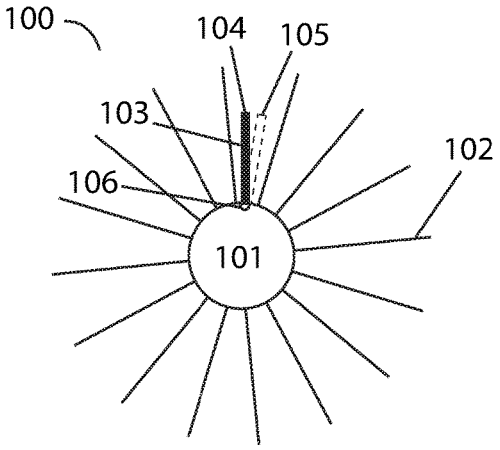
FIG. 1A illustrates a side elevation view of a cross section of a robotic vacuum brush with a pressure sensor in a first position embodying features of the present invention.

Referring to FIG. 1A, a side elevation view of a cross section of a brush 100 is illustrated. Brush 100 is comprised of a shaft 101 and a plurality of bristles 102 projecting radially outward from the shaft. A toggle 103 is disposed along the length of the shaft. The toggle has two positions: a first position 104 that is the default position of the toggle and a second position 105 that the toggle may be forced into by pressure on the toggle. When the toggle is forced into the second position, a sensor 106 is actuated.

Figure 1B:
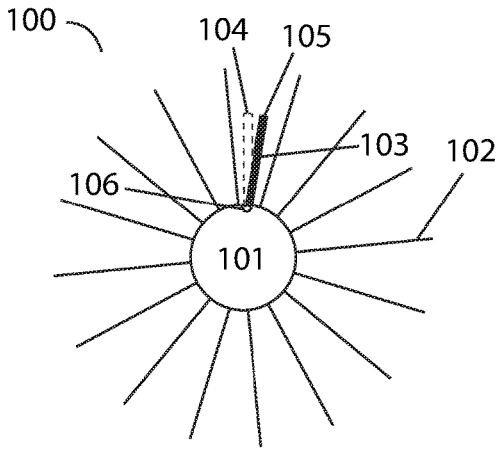
FIG. 1B illustrates a side elevation view of a cross section of a robotic vacuum brush with a pressure sensor in a second position embodying features of the present invention.

Referring to FIG. 1B, a side elevation view of a cross section of the brush 100 with toggle 103 in second position 105 is illustrated.

Figure 2:
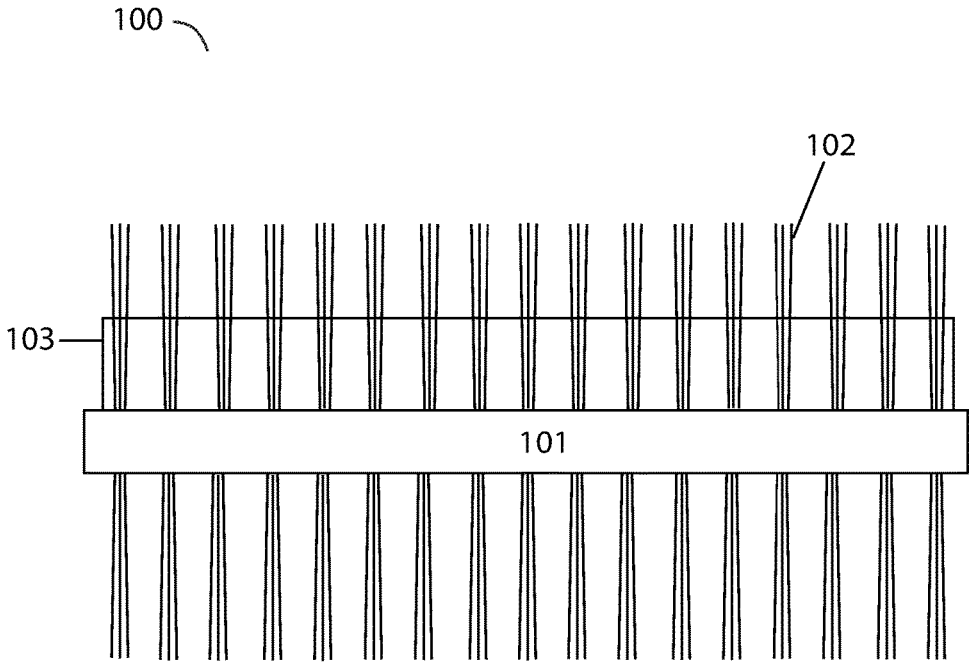
FIG. 2 illustrates front elevation view of a robotic vacuum brush with a pressure sensor embodying features of the present invention.

Referring to FIG. 2, a front elevation view of brush 100 is illustrated. Toggle 103 is disposed along the length of shaft 101. Bristles 102 project radially from shaft 101. The two positions of toggle 103 cannot be seen from this view.

Figure 3A:
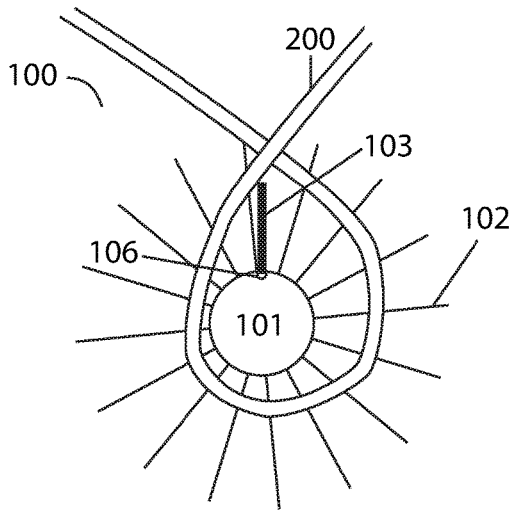
FIG. 3A illustrates a side elevation view of a cross section of a robotic vacuum brush with a pressure sensor becoming entangled with a cord embodying features of the present invention.
Figure 3B:
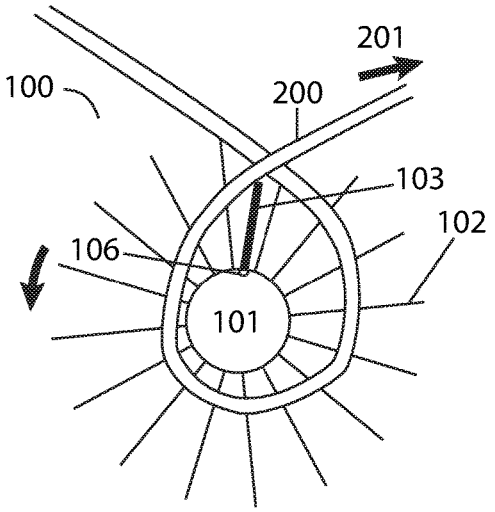
FIG. 3B illustrates a side elevation view of a cross section of a robotic vacuum brush with a pressure sensor that is engaged by a cord entangling the brush embodying features of the present invention.

Referring to FIGS. 3A and 3B, a side view of the operation of the brush when it becomes entangled with a cord is illustrated. In FIG. 3A, a cord 200 has become wrapped around the brush 100. Such occurrence may take place when, for example, a robotic vacuum is cleaning an area where electronics are present and the robotic vacuum drives over a cord. At the point shown in FIG. 3A, the cord has not yet placed enough pressure on the toggle 103 to force it into the second position and actuate the sensor 106. However, as the cord becomes more tightly wound around the brush (which may occur as a result of continued rotation of the brush), as shown in FIG. 3B, the cord eventually puts enough pressure on the toggle 103 to force it in a direction 201, causing the toggle to move to the second position thus actuating the sensor 106. As discussed earlier, any of a variety of responses may be programmed to occur after the sensor has been actuated, such as, but not limited to: halting rotation of the brush, reversing the rotation of the brush, temporarily reversing rotation of the brush, slowing rotation of the brush, pausing rotation of the brush, turning off a device containing the brush, activating an alert on a device containing the brush, sending or displaying a notification to a user, or altering movement or operation of the device containing the brush in any other way. In some embodiments, a response may be triggered only after the sensor has been actuated for a predetermined amount of time.

The foregoing descriptions of specific embodiments of the invention have been presented for purposes of illustration and description. They are not intended to be exhaustive or to limit the invention to the precise forms disclosed. Obviously, many modifications and variations are possible in light of the above teaching. The embodiments were chosen and described in order to explain the principles and the application of the invention, thereby enabling others skilled in the art to utilize the invention in its various embodiments and modifications according to the particular purpose contemplated. The scope of the invention is intended to be defined by the claims appended hereto and their equivalents.

I claim:

1. A brush of a mobile robotic vacuum comprising:

a rotatable shaft with a plurality of bristles radially protruding therefrom;

at least one toggle extending along the length of the shaft; and a pressure sensor actuated by the toggle;

wherein the at least one toggle has a first default position and a second position; and wherein the at least one toggle switches from the first default position into the second position and actuates the pressure sensor if pressure around the brush reaches a predetermined threshold.

2. The brush of claim 1, wherein the pressure sensor is electronically coupled to a processor and/or controller.

3. The brush of claim 2, wherein a response is programmed to occur either immediately when the pressure sensor is actuated or after the pressure sensor has been actuated for a predetermined amount of time.

4. The brush of claim 3, wherein the response includes any of the following, separately or in combination: halting the rotation of the brush, reversing the rotation of the brush, temporarily reversing the rotation of the brush, slowing the rotation of the brush, pausing the rotation of the brush, turning off the robotic vacuum, sending and or displaying a notification to a user, and altering the movement and or operation of the robotic vacuum.

5. The brush of claim 1, wherein the pressure sensor is any of: a mechanical sensor, an electronic pressure sensor, and a pressure actuated switch.

6. The brush of claim 1, further comprising a plurality of toggles extending along the length of the shaft.

7. A mobile robotic vacuum comprising:

at least one rotatable brush, comprising:

a rotatable shaft with a plurality of bristles radially protruding therefrom;

at least one toggle extending along the length of the shaft; and, a pressure sensor actuated by the at least one toggle;

wherein the toggle has a first default position and a second position; and wherein the toggle switches from the first default position into the second position and actuates the sensor if pressure around the brush reaches a predetermined threshold.

8. The robotic vacuum of claim 7 further comprising a plurality of toggles in extending along the length of the shaft.

9. The robotic vacuum of claim 7, wherein the pressure sensor is electronically coupled to a processor and/or controller.

10. The robotic vacuum of claim 9, wherein a response is programmed to occur either immediately when the pressure sensor is actuated or after the pressure sensor has been actuated for a predetermined amount of time.

11. The robotic vacuum of claim 10, wherein the response includes any of the following, separately or in combination: halting the rotation of the brush, reversing the rotation of the brush, temporarily reversing the rotation of the brush, slowing the rotation of the brush, pausing the rotation of the brush, turning off the robotic vacuum, sending and or displaying a notification to a user, and altering the movement and or operation of the robotic vacuum.

12. The robotic vacuum of claim 7, wherein the pressure sensor is any of: a mechanical sensor, an electronic pressure sensor, and a pressure actuated switch.

13. A system for detecting and responding to brush entanglement with an obstruction comprising:

at least one rotatable brush, comprising a rotatable shaft with a plurality of bristles radially protruding therefrom;

at least one toggle extending along the length of the shaft; and, a pressure sensor actuated by the toggle;

wherein the at least one toggle has a first default position and a second position; and wherein the at least one toggle switches from the first default position into the second position and actuates the sensor if pressure around the brush reaches a predetermined threshold.

14. The system of claim 13, wherein the actuation of the pressure sensor triggers any of the following responses, separately or in combination: halting the rotation of the brush, reversing the rotation of the brush, temporarily reversing the rotation of the brush, slowing the rotation of the brush, pausing the rotation of the brush, turning off a device housing the brush, sending and or displaying a notification to a user, and altering the movement and or operation of a device housing the brush, either immediately or after the pressure sensor has been actuated for a predetermined amount of time.

15. The system of claim 13, wherein the pressure sensor is any of: a mechanical sensor, an electronic pressure sensor, and a pressure actuated switch.

16. The system of claim 13, further comprising a plurality of toggles extending along the length of the shaft.

* * * * *